US010513818B2

(12) United States Patent
Favaro et al.

(10) Patent No.: US 10,513,818 B2
(45) Date of Patent: Dec. 24, 2019

(54) LAUNDRY WASHING MACHINE EQUIPPED WITH A TREATING AGENTS DISPENSER

(71) Applicant: Electrolux Appliances Aktiebolag, Stockholm (SE)

(72) Inventors: Daniele Favaro, Pramaggiore (IT); Maurizio Del Pos, Pordenone (IT)

(73) Assignee: Electrolux Appliances Aktiebolag (SE)

( * ) Notice: Subject to any disclaimer, the term of this patent is extended or adjusted under 35 U.S.C. 154(b) by 0 days.

(21) Appl. No.: 15/620,127

(22) Filed: Jun. 12, 2017

(65) Prior Publication Data

US 2017/0356119 A1 Dec. 14, 2017

(30) Foreign Application Priority Data

Jun. 14, 2016 (EP) ..... 16174317

(51) Int. Cl.
*A47B 88/90* (2017.01)
*D06F 37/04* (2006.01)
(Continued)

(52) U.S. Cl.
CPC ..... *D06F 39/028* (2013.01); *A47B 88/90* (2017.01); *D06F 37/04* (2013.01); *D06F 37/22* (2013.01); *D06F 37/266* (2013.01); *D06F 37/304* (2013.01); *D06F 39/005* (2013.01); *D06F 39/02* (2013.01); *D06F 39/022* (2013.01);
(Continued)

(58) Field of Classification Search
CPC ..... A47B 88/90; A47B 2210/17; D06F 37/04; D06F 37/22; D06F 37/266; D06F 37/304; D06F 39/005; D06F 39/022; D06F 39/028; D06F 39/12
USPC .... 68/12.02, 12.18, 12.27, 13 R, 17 R, 23.1, 68/24, 139, 140, 142, 207
See application file for complete search history.

(56) References Cited

U.S. PATENT DOCUMENTS

2005/0229645 A1 10/2005 Kim et al.

FOREIGN PATENT DOCUMENTS

| | | | |
|---|---|---|---|
| DE | 10150878 | A1 | 7/2002 |
| EP | 1607509 | A1 | 12/2005 |
| EP | 2447410 | A1 | 5/2012 |

OTHER PUBLICATIONS

Corradin et al., "DE10150878A1 English Machine Translation.pdf", Jul. 18, 2002—Machine translation from Espacenet.com.*
(Continued)

*Primary Examiner* — Levon J Shahinian
(74) *Attorney, Agent, or Firm* — RatnerPrestia

(57) ABSTRACT

A laundry washing machine (1) connectable to a water mains (E, E') has a cabinet (2) supporting a washing tub (3) external to a rotatable washing drum (4) suited to receive laundry and a treating agents dispenser (20) connectable to the water mains (E, E') by means of at least one supply valve (40*a*, 40*b*, 40*c*, 40*d*, 40*e*). The treating agents dispenser (20) has a drawer (22) and a supporting structure (21) on which the drawer (22) can slide along a sliding axis (S). A water distributor (35) includes at least one inlet connector (36*a*, 36*b*, 36*c*, 36*d*, 36*e*) adapted to connect the at least one supply valve (40*a*, 40*b*, 40*c*, 40*d*, 40*e*) to at least one water conveying line (120*a*, 120*b*, 120*c*, 120*d*, 120*e*) for conveying water to a reservoir (23*a*, 23*b*, 23*c*, 23*d*) or to the washing tub (3). The at least one inlet connector (36*a*, 36*b*, 36*c*, 36*d*, 36*e*) extends along a main axis (X) which is inclined with respect to the sliding axis (S).

16 Claims, 13 Drawing Sheets

(51) Int. Cl.

| | |
|---|---|
| ***D06F 37/22*** | (2006.01) |
| ***D06F 37/26*** | (2006.01) |
| ***D06F 37/30*** | (2006.01) |
| ***D06F 39/00*** | (2006.01) |
| ***D06F 39/02*** | (2006.01) |
| ***D06F 39/12*** | (2006.01) |
| ***D06F 39/08*** | (2006.01) |

(52) U.S. Cl.
CPC ..... *D06F 39/088* (2013.01); *D06F 39/12* (2013.01); *A47B 2210/17* (2013.01)

(56) References Cited

OTHER PUBLICATIONS

Extended European Search Report dated Jan. 3, 2017 in corresponding European Application No. 16174317.4.

* cited by examiner

LAUNDRY WASHING MACHINE EQUIPPED WITH A TREATING AGENTS DISPENSER

CROSS REFERENCE TO RELATED APPLICATION

This application claims priority to European Application No. 16174317.4 filed Jun. 14, 2016, the content of which is hereby incorporated by reference in its entirety.

BACKGROUND

The present invention concerns the field of laundry washing techniques.

In particular, the present invention refers to a treating agents dispenser in a laundry washing machine.

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread. In the present description the term "laundry washing machine" will refer to both simple laundry washing machine and laundry washing-drying machine.

Laundry washing machines generally comprise an external casing, or cabinet, provided with a washing tub which contains a rotatable perforated drum where the laundry is placed. A loading/unloading door ensures access to the drum. Laundry washing machines typically comprise a treating agents dispenser arranged to the frontal side wall of the cabinet, opportunely in an upper region of the latter, positioned above the tub for the introduction of water and treating agents (i.e. detergent, softener, rinse conditioner, etc.) into the tub.

Known treating agents dispensers comprise one or more reservoirs, or compartments, adapted to be filled with at least one treating agent and one or more respective water conveying lines for conveying water to the compartments. Water conveying lines are typically realized in a water distributor placed above the compartments. The water distributor is opportunely shaped to define channels provided with apertures allowing water coming from the water main to fall down in the underlying compartments.

Known treating agents dispensers are advantageously connectable to a water source via dedicated controllable supply valves. Typically, the water source adducts cold water to the treating agents dispenser. Other known treating agents dispensers are connectable to a warm or hot water source.

The cabinet of the laundry washing machine typically has at the rear an access for allowing a connection to the water/s source/s and said supply valves are arranged closed to, or fixed to, the inner side of the rear wall of the cabinet. One or more connecting pipes are then utilized to connect at one end said valves and at an opposite end the water distributor of the treating agents dispenser. For this purpose, water distributors of known type are provided with horizontal inlet connectors rearwardly projecting from the body of the water distributor which are connected to said opposite ends of the connecting pipes. Furthermore, fastening means, for example a clamp, are used to secure ends of the pipes and valves and/or inlets of the water distributor tightly together. However, the system for supplying water above described belonging to the known art poses some drawbacks.

A first drawback posed by the known technique is constituted by the fact that the system for supplying water is cumbersome. In fact, said arrangement comprises said treating agents dispenser, horizontal inlet connectors rearwardly projecting from the water distributor, connecting pipe/s and valves wherein all these elements are substantially aligned from the front side of the cabinet to the rear side of the same. In particular, the connection system between valves and the water distributor comprising connecting pipe/s requires a relevant space at the rear side of the laundry washing machine. This firstly negatively affects the size of the laundry washing machine, in particular the distance between the front side and the rear side of the laundry washing machine. This also negatively affects manufacturing costs of the treating agents dispenser and/or of the drawer of the laundry washing machine. On the other hand, a prefixed distance between the front side and the rear side of the laundry washing machine, for example size required by standards, limits the size of the treating agents dispenser and in particular of the drawer.

SUMMARY OF SELECTED INVENTIVE ASPECTS

The main object of the present invention is therefore to overcome said drawbacks. In particular, it is one object of the present invention to provide a laundry washing machine having a treating agents dispenser with reduced size compared to laundry washing machines of known type.

It is another object of the invention to provide a laundry washing machine having a higher capacity of the drawer compared to laundry washing machines of known type of the same size.

It is a further object of the invention to provide a laundry washing machine having a treating agents dispenser with reduced complexity compared to laundry washing machines of known type.

The applicant has found that by providing a laundry washing machine having a treating agents dispenser comprising a supporting structure on which a drawer can slide along a sliding axis and a water distributor for conveying water to a reservoir or to a washing tub wherein the water distributor comprises an inlet connector which extends along a main axis which is inclined with respect to the sliding axis, it is possible to reduce the size of the treating agents dispenser and/or of the laundry washing machines compared to known technique.

The present invention relates, therefore, to a laundry washing machine connectable to a water mains comprising a cabinet supporting a washing tub enclosing a rotatable washing drum suited to receive laundry and a treating agents dispenser connectable to said water mains by means of at least one supply valve, said treating agents dispenser comprising:

- a drawer and a supporting structure on which said drawer can slide along a sliding axis;
- a water distributor comprising at least one water conveying line for conveying water to a reservoir or to said washing tub and at least one inlet connector, said at least one inlet connector being adapted to connect said at least one supply valve to said at least one water conveying line;

wherein said at least one inlet connector extends along a main axis which is inclined with respect to said sliding axis.

Advantageously, the interspace between the treating agents dispenser and the supply valve can be minimize.

According to a preferred embodiment of the invention, the reservoir comprises a compartment of the drawer suitable to receive an agent for treating laundry.

According to another preferred embodiment of the invention, the reservoir comprises a container suitable to receive a water softening product to be used in a water softening device of the laundry washing machine.

Preferably, the container is supported by the drawer or by the supporting structure or is external to the treating agents dispenser.

In a preferred embodiment of the invention, the main axis is perpendicular with respect to the sliding axis.

Preferably, the main axis is arranged in a vertical plane or substantially vertical plane, when the treating agents dispenser is mounted in an operational position.

Preferably, the sliding axis is arranged in a horizontal or substantially horizontal plane, when the treating agents dispenser is mounted in an operational position.

According to a preferred embodiment of the invention, said at least one inlet connector is integrally made with the water distributor.

In a preferred embodiment of the invention, the water distributor comprises a first part and a second part structured for being reciprocally coupled.

According to a preferred embodiment of the invention, said at least one inlet connector is integrally made with one of said first or second parts of said water distributor.

According to another preferred embodiment of the invention, said at least one inlet connector is coupled to said water distributor.

In a further preferred embodiment of the invention, the said at least one inlet connector is part of a unit sandwiched between said first and second parts.

Preferably, the machine further comprises a pipe fluidly connecting said at least one inlet connector to said at least one supply valve.

According to a preferred embodiment of the invention, said at least one supply valve is arranged spaced apart from the free end of said at least one inlet connector along the main axis.

Preferably, said at least one supply valve is arranged vertically below the free end of said at least one inlet connector.

In a preferred embodiment of the invention, the water distributor is placed above the drawer when the treating agents dispenser is mounted in an operational position.

According to a preferred embodiment of the invention, the drawer comprises one ore compartments for receiving an agent for treating laundry.

Preferably, the machine further comprises a supply pipe fluidly connecting the treating agents dispenser and the washing tub.

Preferably, the drawer is movable in a withdrawal direction in order to extract the drawer from said supporting structure and is movable in a pushing direction in order to insert the drawer into the supporting structure.

Preferably, the withdrawal direction and/or the pushing direction is parallel to the sliding axis.

BRIEF DESCRIPTION OF THE DRAWINGS

Further characteristics and advantages of the present invention will be highlighted in greater detail in the following detailed description of preferred embodiments of the invention, provided with reference to the enclosed drawings. In the drawings, corresponding characteristics and/or components are identified by the same reference numbers. In such drawings.

DETAILED DESCRIPTION OF EXEMPLARY EMBODIMENTS

Figure 1:
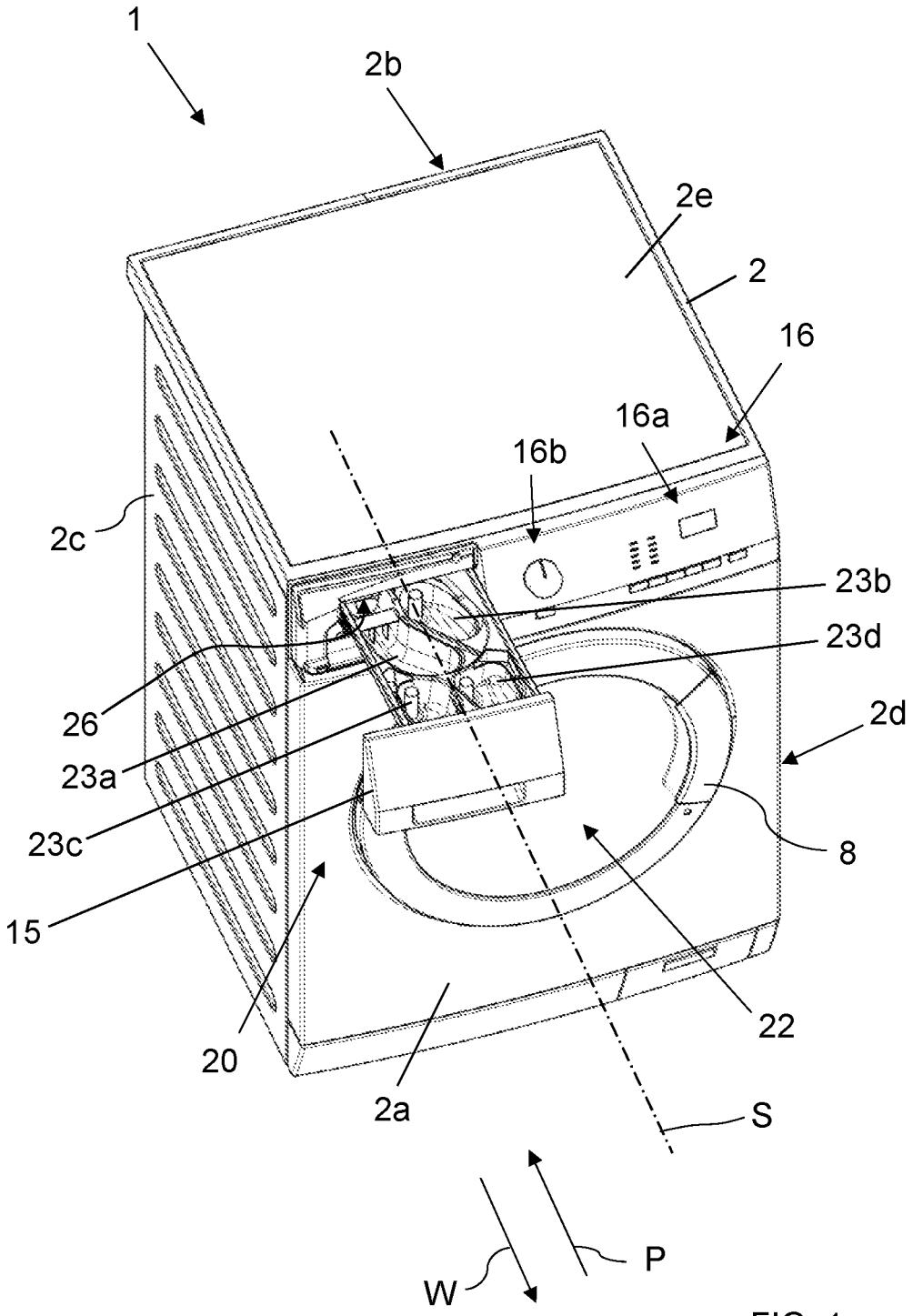
FIG. 1 shows a perspective view of a laundry washing machine equipped with a treating agents dispenser with the drawer in its opened loading position according to a preferred embodiment of the invention.
Figure 2:
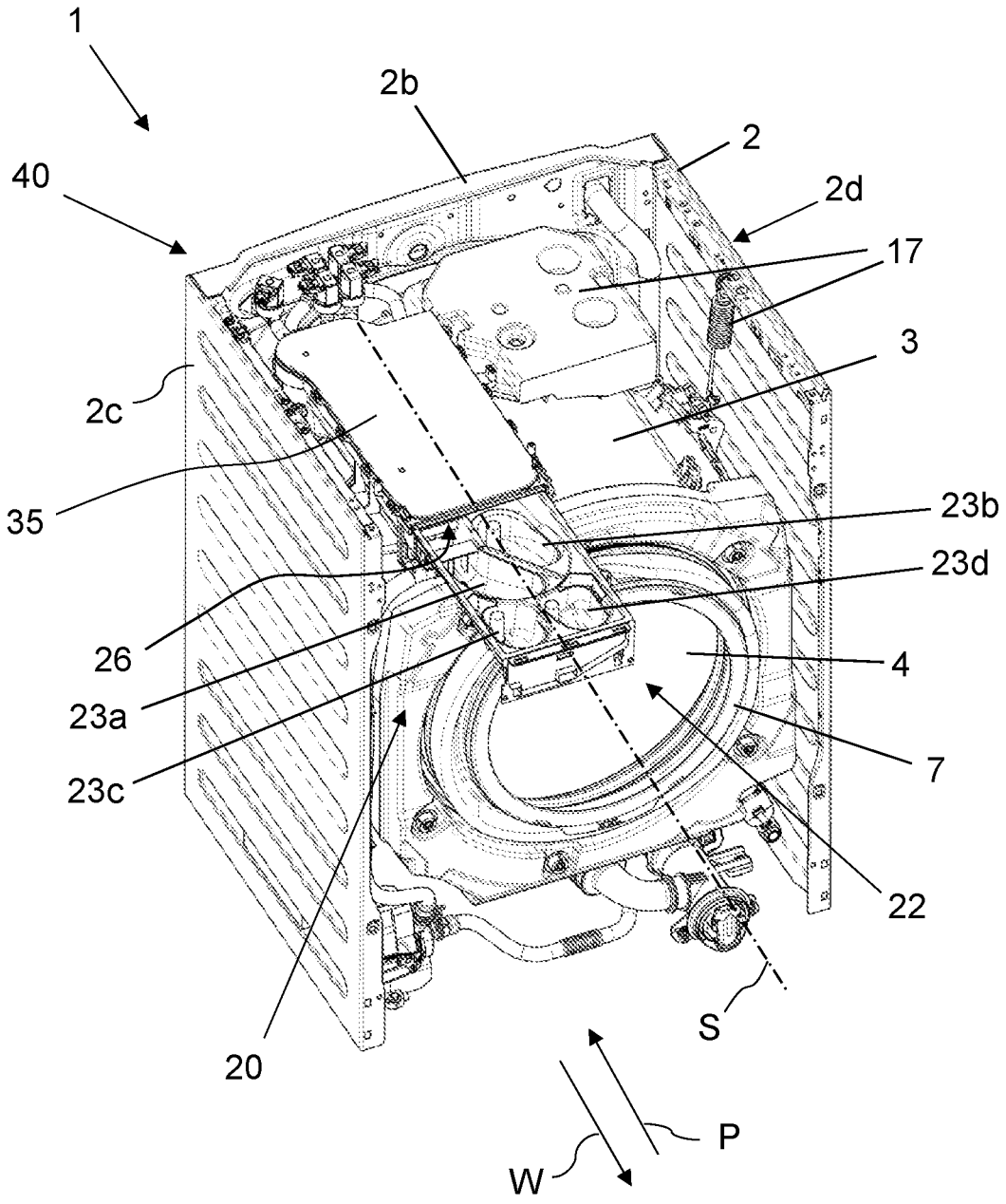
FIG. 2 shows the laundry washing machine of FIG. 1 with the front side wall and the upper side wall removed therefrom.

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry). In the present description, therefore, the term "laundry washing machine" will refer to both simple laundry washing machine and laundry washing-drying machine.

A laundry washing machine 1 equipped with a treating agents dispenser according to a preferred embodiment of the invention is described with reference to FIGS. 1 to 10.

The laundry washing machine 1 comprises an external casing or cabinet 2, in which a washing tub 3 is provided that contains a perforated washing drum 4 where the laundry to be treated can be loaded. The cabinet 2 comprises a vertical front side wall 2*a*, a vertical rear side wall 2*b*, two vertical lateral side walls 2*c*, 2*d* and an upper side wall 2*e*. The cabinet 2 is provided with a loading/unloading door 8 which allows access to the drum 4. The tub 3 is preferably suspended in a floating manner inside the cabinet 2, advantageously by means of a number of coil springs and shock-absorbers 17.

The drum 4 is advantageously rotated by an electric motor (not shown) which preferably transmits the rotating motion to the shaft of the drum 4, advantageously by means of a belt/pulley system (not shown). In a different embodiment of the invention, the motor can be directly associated with the shaft of the drum 4.

The drum 4 is advantageously provided with holes which allow the liquid flowing therethrough. Said holes are typically and preferably homogeneously distributed on the cylindrical side wall of the drum 4.

The tub 3 is preferably connected to the cabinet 2 by means of an elastic bellows 7, or gasket. The bellows 7 is preferably S-shaped.

Laundry washing machine 1 advantageously comprises a control unit (not shown), connected to the various parts of the laundry washing machine 1 in order to ensure its operation. Laundry washing machine 1 preferably comprises an interface unit 16, connected to the control unit, accessible to the user and by means of which the user may select and set the washing parameters, like for example a desired washing program. Usually, other parameters can optionally be set by the user, for example the washing temperature, the spinning speed, etc. The interface unit 16 preferably comprises a display 16*a* which displays machine working conditions.

The unit interface 16 then preferably comprises one or more selector devices which allow to select the appropriate washing program and/or to set other parameters. For example, the selector devices may comprise a selector 16*b* (a rotary knob) which advantageously allows to select the appropriate washing program. The selector devices may then preferably comprise push buttons.

The laundry washing machine 1 advantageously comprises a treating agents dispenser 20 to supply treating agents into the tub 3 during a washing cycle. Treating agents may comprise, for example, detergents, rinse additives, fabric softeners or fabric conditioners, waterproofing agents, fabric enhancers, rinse sanitization additives, chlorine-based additives, etc.

Advantageously, the treating agents dispenser 20 comprises a supporting structure 21, connected to the cabinet 2, internally to the latter, preferably by suitable fixing means, comprising, for example, screws or rivets, not illustrated, or also glue, or welding. Preferably, the supporting structure 21 comprises a housing, more preferably a box-shaped housing 21.

In the enclosed Figures, the housing 21 is advantageously substantially parallelepiped, and it is connected to the frontal side wall 2*a* of the cabinet 2, opportunely in an upper region of the latter, positioned above the tub 3. The housing 21 contains a removable drawer 22 which can be extracted from the housing 21, such as to protrude from the cabinet 2 in an opened position, as illustrated for example in FIGS. 1 and 2, or can be fully inserted into the housing 21 in a closed position, as illustrated for example in FIGS. 3, 4 and 5.

The drawer 22 preferably comprises a front panel 15 with a handle by means of which the drawer 22 can be moved from the closed position to an opened position and, vice-versa, can be moved from an opened position to the closed position. For simplicity's sake, the front panel 15 has been removed in FIG. 2.

The movement of the drawer 22 takes place along a sliding axis S and the drawer 22 can move along a withdrawal direction W when the drawer 22 is being opened and along a push direction P when the drawer 22 is being closed. The withdrawal direction W and the push direction P are preferably parallel to the sliding axis S. The movement of the drawer 22 preferably takes place on a horizontal, or substantially horizontal, plane, i.e. the sliding axis S lies on a horizontal, or substantially horizontal, plane.

The drawer 22 is preferably provided with one or more reservoirs 23*a*, 23*b*, 23*c*, 23*d*, or compartments, adapted to be filled with treating agents. In the embodiment illustrated in the Figures, there are four compartments, 23*a*, 23*b*, 23*c* and 23*d*. In different embodiments, not illustrated, the number of compartments may be different, according to the desired type and number of treating agents which are used in the particular model of laundry washing machine.

The first compartment 23*a* is preferably adapted for receiving a powder detergent; the second compartment 23*b* is preferably adapted for receiving a quantity of liquid detergent; the third compartment 23*c* is preferably adapted for receiving bleach; the fourth compartment 23*d* is preferably adapted for receiving a softener. In different embodiments, other treating agents may be used, such as fabric conditioners, waterproofing agents, fabric enhancers, rinse sanitization additives, chlorine-based additives, etc.

The compartments 23*a*, 23*b*, 23*c* and 23*d* are fluidly connected to the bottom of the housing 21, preferably to the rear portion of this bottom, in which an outlet port (not shown) is preferably provided. The outlet port is adapted to allow the flowing of a liquid into a supply pipe (not shown) fluidly connecting the treating agents dispenser 20 and the tub 3.

It is underlined that in the present application saying that a first component is "fluidly connected" to a second component means that a fluid can flow from the first component to the second component and vice versa.

The first compartment 23*a* of the drawer 22 is fluidly connected to the bottom of the housing 21 through an aperture 26 defined at the rear of the first compartment 23*a*. The aperture 26 is adapted to allow the flowing of a liquid into the supply pipe fluidly connecting the treating agents dispenser 20 and the tub 3. The other compartments 23*b*, 23*c* and 23*d* of the drawer 22 are preferably fluidly connected to the bottom of the housing 21 through respective siphons.

Figure 8:
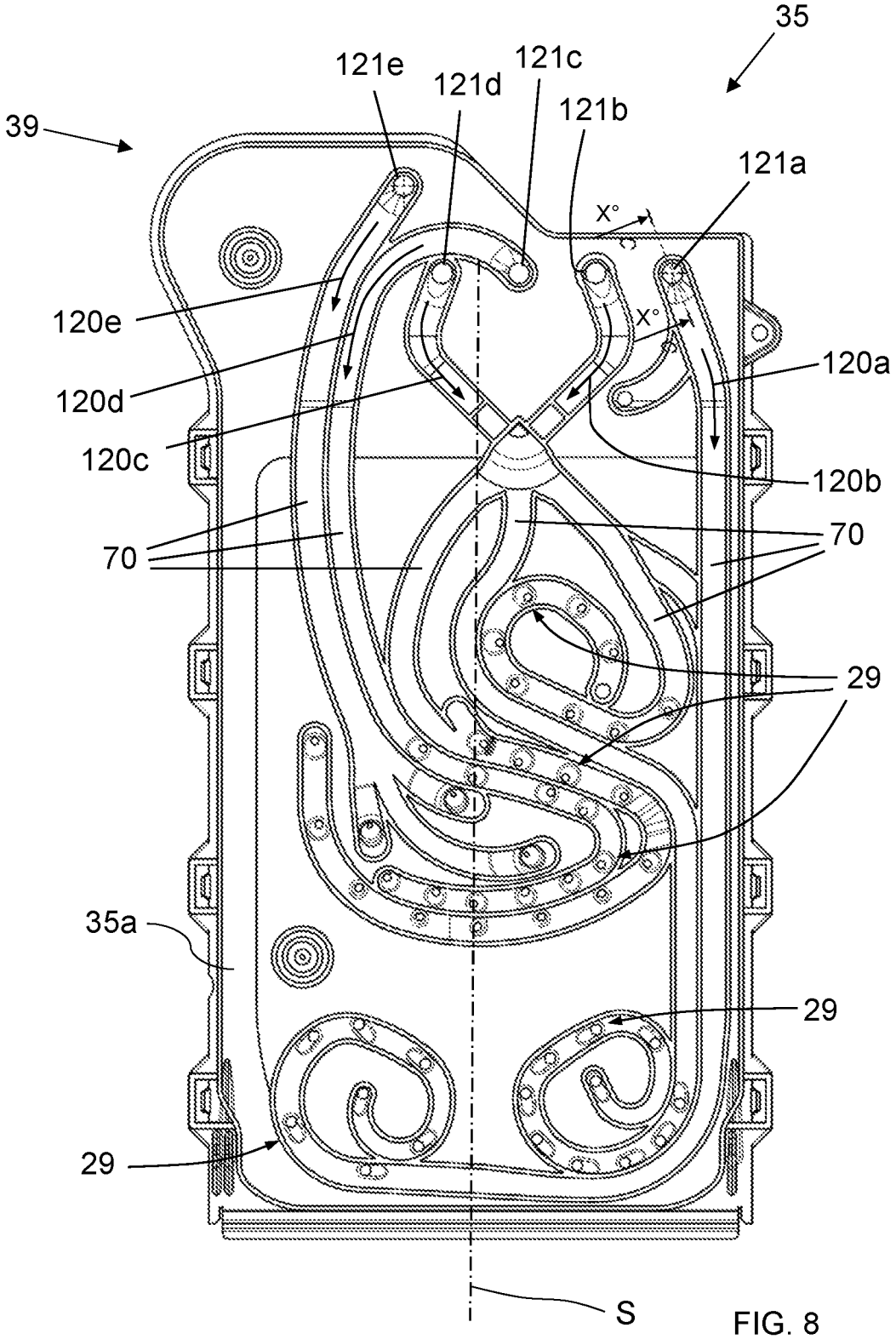
FIG. 8 shows a plan upper view of a particular of FIG. 7.
Figure 9:
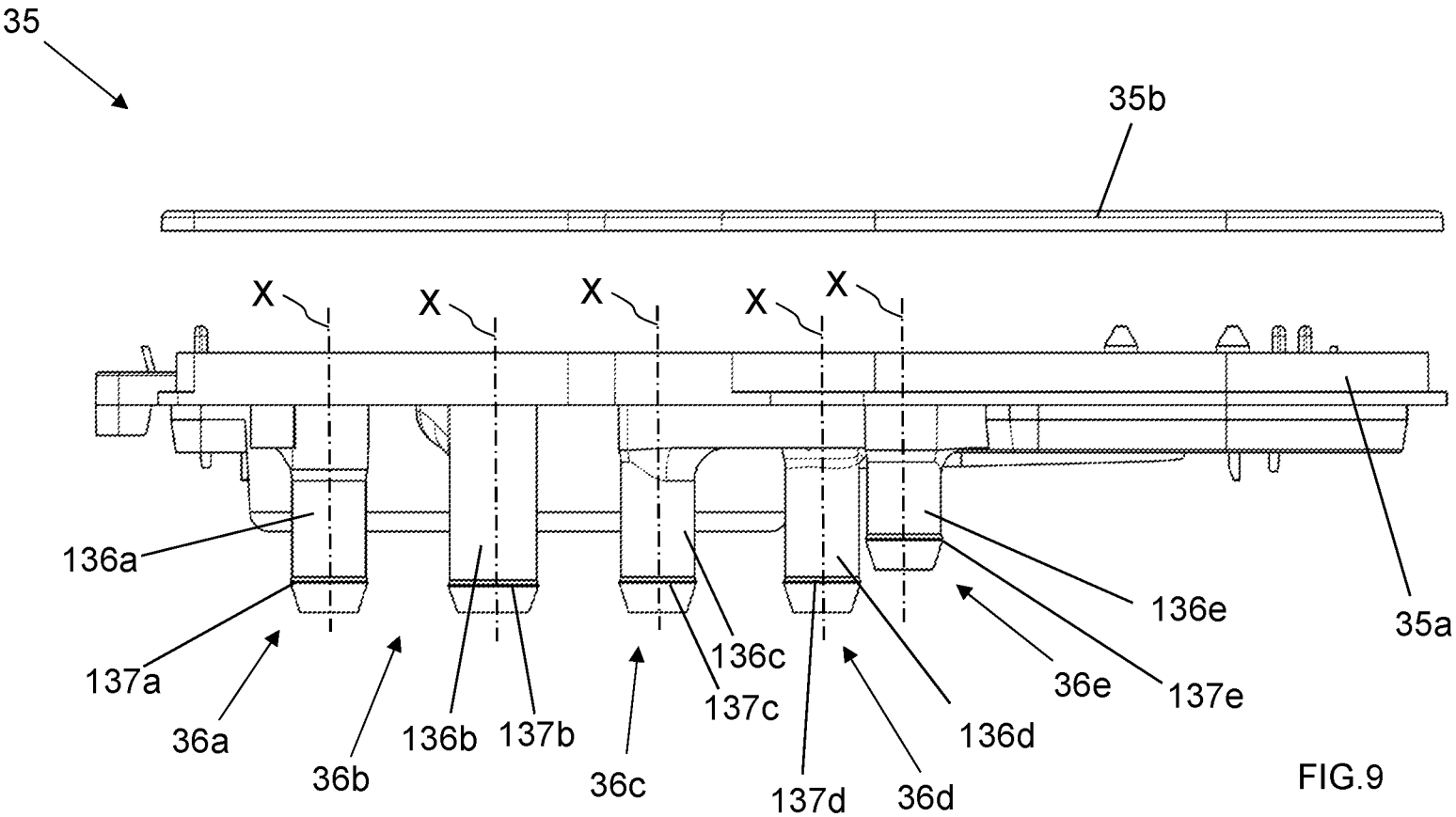
FIG. 9 shows a lateral side view of FIG. 7.
Figure 10:
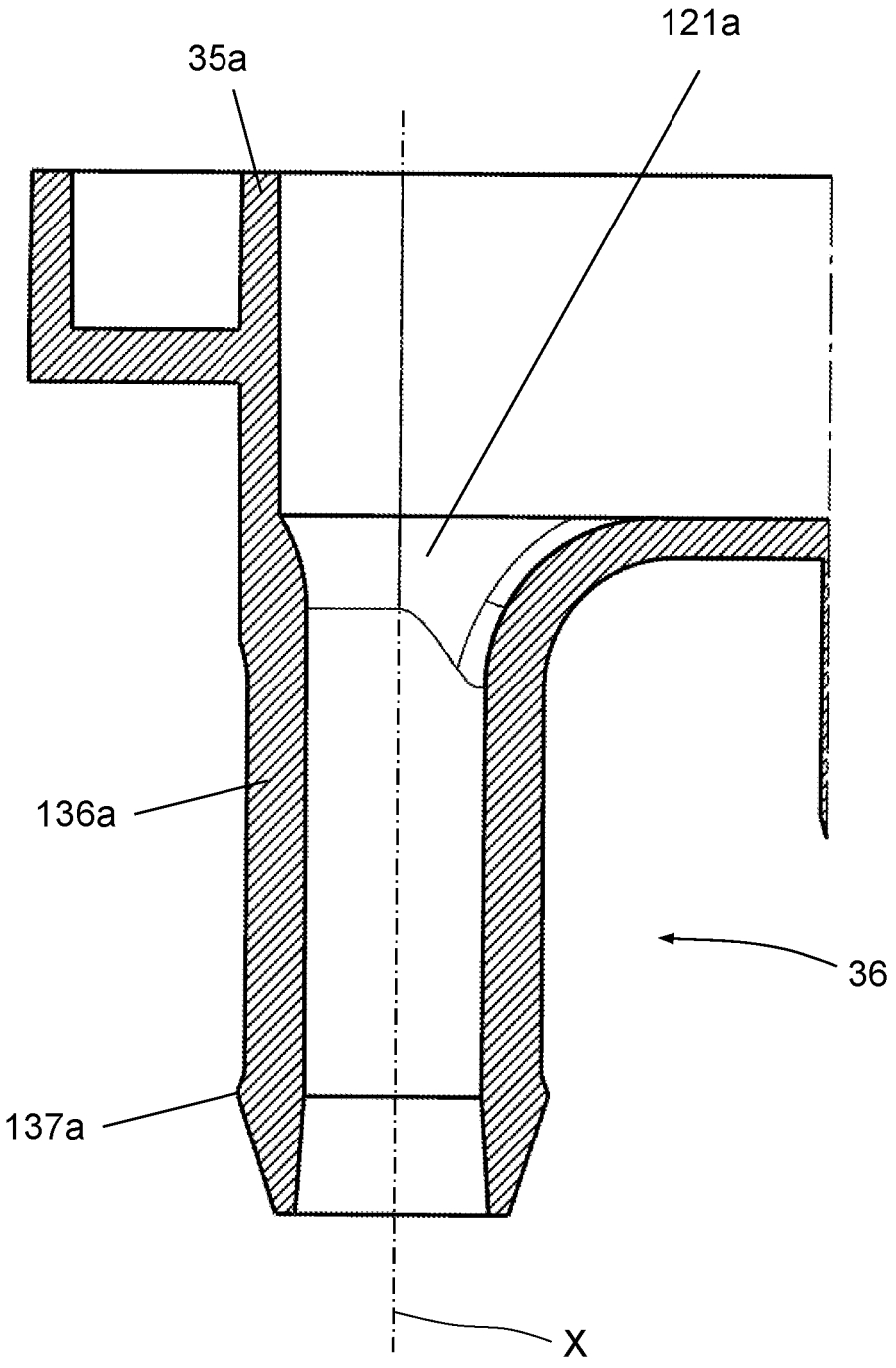
FIG. 10 shows a sectional view of FIG. 8 sectioned along line X°-X°.

The treating agents dispenser 20 further comprises a water distributor 35, associated to the housing 21 and placed above the drawer 22 in such a way to allow the flowing of water to one or more of said compartments 23*a*, 23*b*, 23*c*, 23*d*. The water distributor 35 comprises one or more water conveying lines 120*a*, 120*b*, 120*c*, 120*d*, 120*e*, as illustrated in FIG. 8, adapted for selectively conveying water to one or more of said compartments 23*a*, 23*b*, 23*c*, 23*d*.

In the preferred embodiment herewith illustrated and described, there are five water conveying lines 120*a*, 120*b*, 120*c*, 120*d*, 120*e*. The water conveying lines 120*a*, 120*b*, 120*c*, 120*d*, 120*e* are opportunely shaped to create channels 70 adapted for conveying water to one or more of said compartments 23*a*, 23*b*, 23*c*, 23*d* of the drawer 22 when the latter is placed in its closed operative position.

To this purpose, the channels 70 are provided with outlets 29 facing the underlying compartments 23*a*, 23*b*, 23*c*, 23*d* that allow the passage of the water from the water distributor 35 to the underlying compartments 23*a*, 23*b*, 23*c*, 23*d*. The water conveying lines 120*a*, 120*b*, 120*c*, 120*d*, 120*e* comprise respective inlets 121*a*, 121*b*, 121*c*, 121*d*, 121*e* through which water may flow. Inlets 121*a*, 121*b*, 121*c*, 121*d*, 121*e* are preferably arranged close to the rear side 39 of the distributor 35. In the preferred embodiment herewith illustrated and described, there are five water conveying lines 120*a*, 120*b*, 120*c*, 120*d*, 120*e* and six channels 70. In different embodiments, the number and/or the shape of the water conveying lines and/or of the channels could be different according, in particular, to the number of compartments of the drawer.

The water distributor 35 preferably comprises a lower part 35*a* and an upper closing part 35*b* structured for being reciprocally coupled to form the water distributor 35. The two parts 35*a*, 35*b* are preferably coupled by welding and/or glueing and/or joint. The water distributor 35 preferably has a substantially flattened configuration. The water distributor 35 preferably extends along the sliding axis S and preferably lies in the horizontal, or substantially horizontal, plane when the treating agents dispenser 20 is mounted in an operational position.

The water distributor 35 is apt to be connected to a first external water source E which could comprise, for example, the plumbing of the building in which the laundry washing machine 1 is installed. The first water source E is preferably a source for the adduction of cold water. In the embodiment illustrated in the enclosed Figures the water distributor 35 is further apt to be connected to a second external water source E'. The second water source E' is preferably a source of warm or hot water. The second water source E' can be fed with warm or hot water obtained, for example, by a solar thermal collector.

Figure 3:
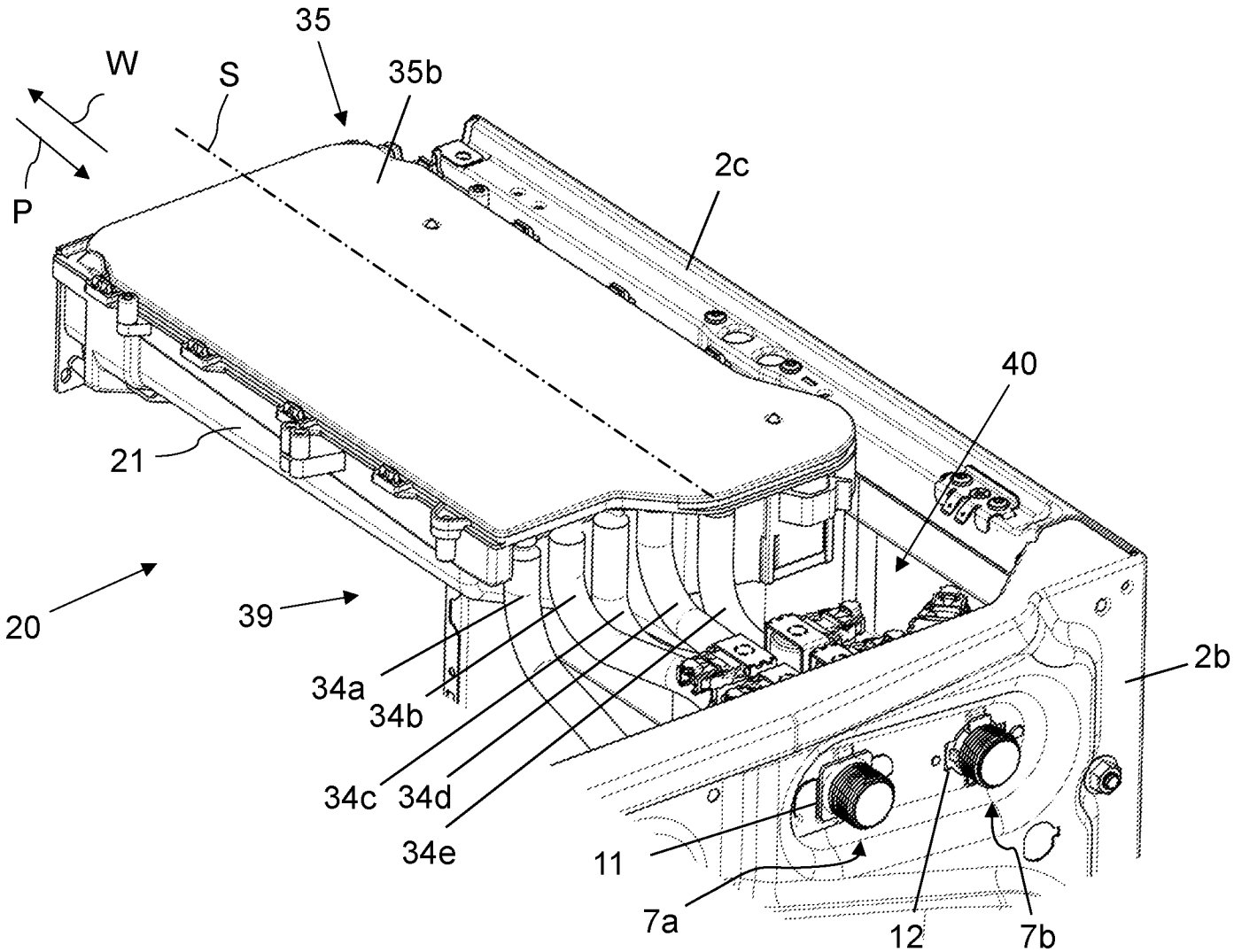
FIG. 3 is a partial perspective rear view of the laundry washing machine of FIG. 2 with the drawer in its closed position.
Figure 4:
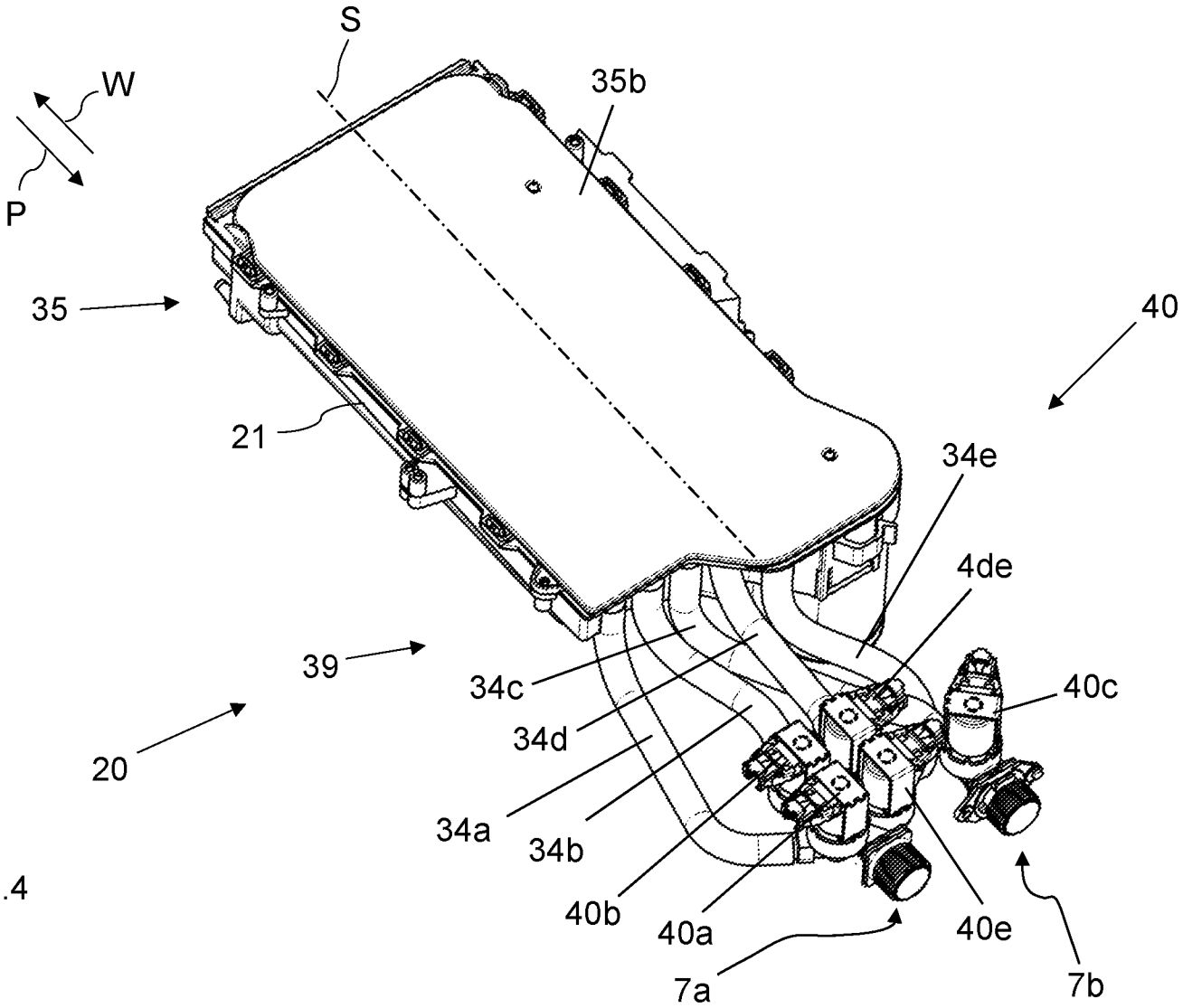
FIG. 4 shows some elements of FIG. 3 isolated from the rest.
Figure 5:
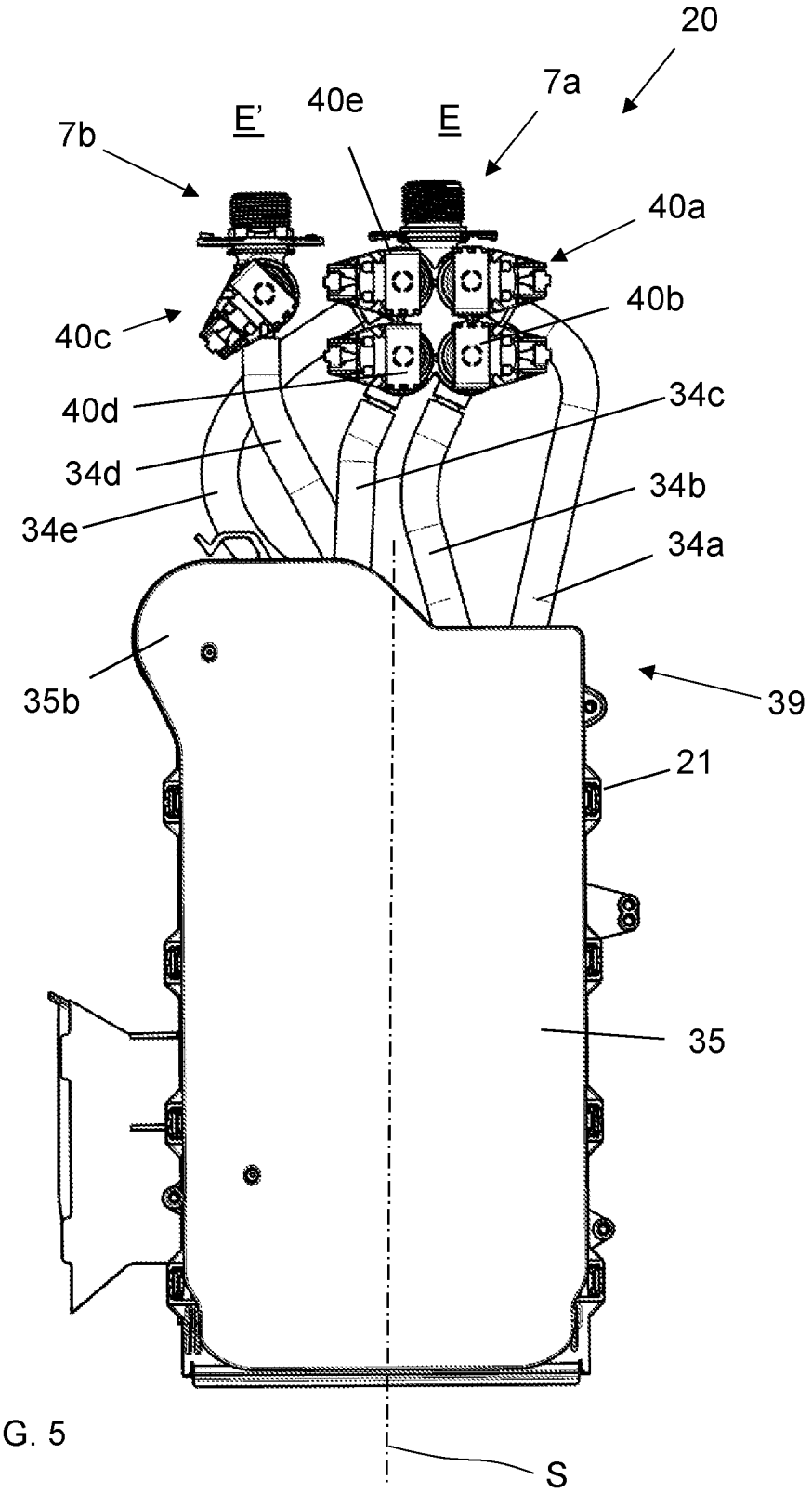
FIG. 5 shows a plan top view of FIG. 4.
Figure 6:
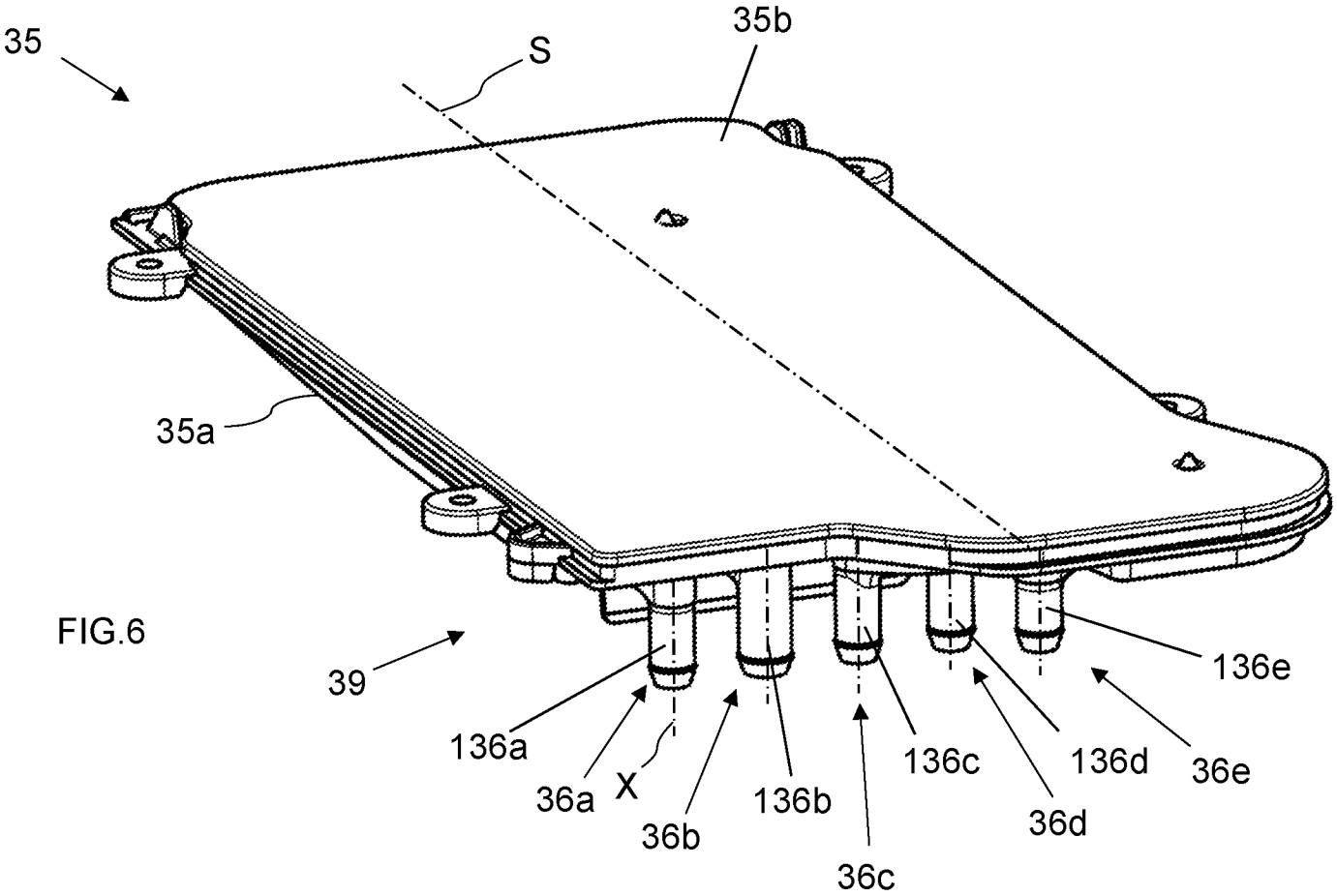
FIG. 6 shows an element of FIG. 4 isolated from the rest.
Figure 7:
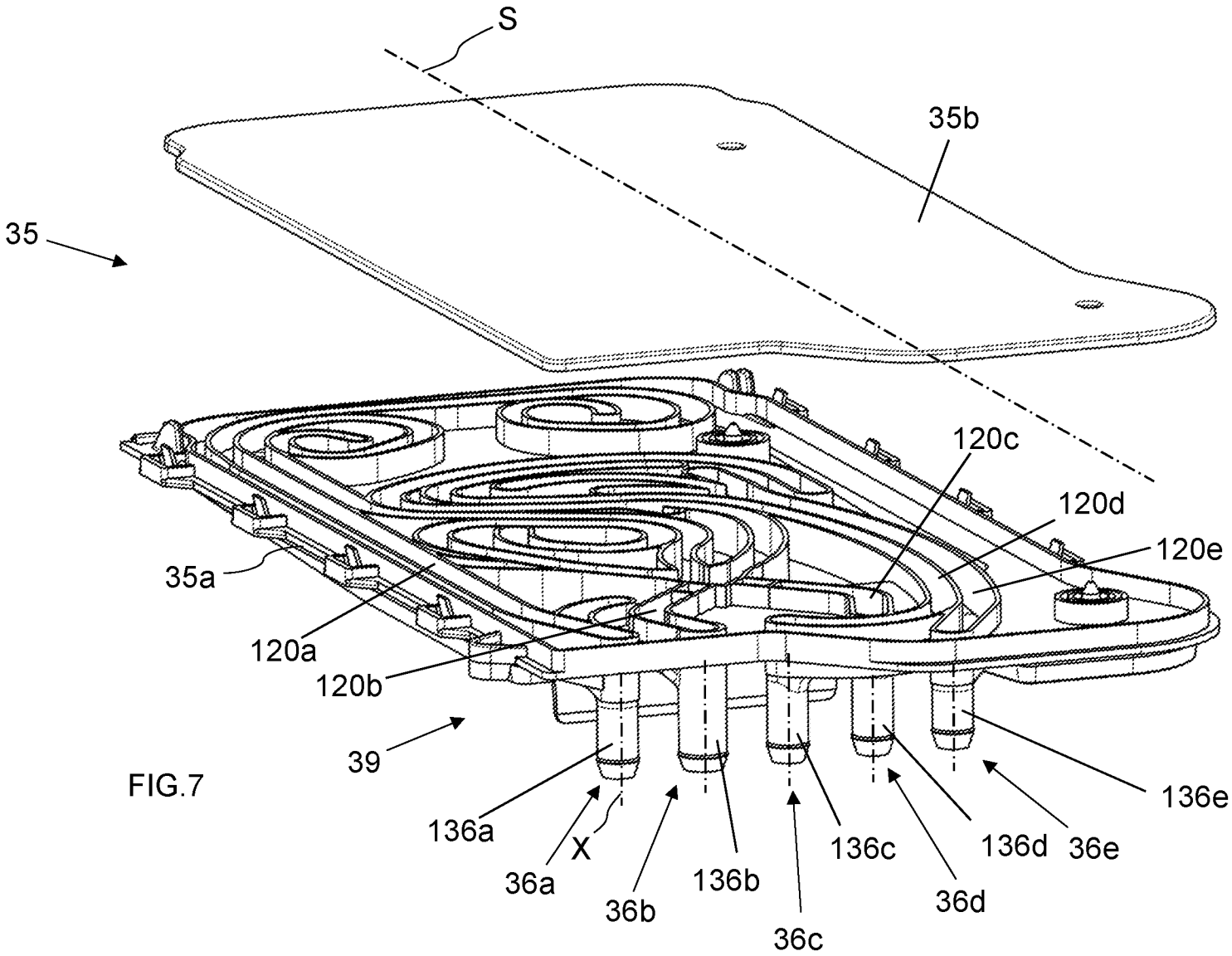
FIG. 7 shows an exploded view of FIG. 6.

The laundry washing machine 1 is therefore provided with a first inlet duct 7*a* and a second inlet duct 7*b* for the hydraulic connection to the first water source E and the second water source E', respectively. To this purpose, the rear side wall 2*b* of the cabinet 2, as illustrated in FIG. 3, preferably comprises a first aperture 11 which receives the first inlet duct 7*a* and a second aperture 12 which receives the second inlet duct 7*b*. The first and second inlet ducts 7*a*, 7*b* are preferably associated to a valves assembly 40.

The valves assembly 40 preferably comprises five controllable valves 40*a*, 40*b*, 40*c*, 40*d* and 40*e*, preferably of the electromagnetic type, opportunely controlled by the control unit. Preferably, first, second, fourth and fifth controllable valves 40*a*, 40*b*, 40*d* and 40*e* are fluidly connected to the first inlet duct 7*a* and the third controllable valve 40*c* is fluidly connected to the second inlet duct 7*b*.

The valves assembly 40 allows adduction of cold and/or hot water from the water sources E, E' to the conveying lines 120*a*, 120*b*, 120*c*, 120*d*, 120*e* of the distributor 35, as further described later. The valves assembly 40 is preferably fixedly associated to the cabinet 2. Preferably the valves assembly 40 is fixedly associated to the inner side of the vertical rear side wall 2*b*.

According to an aspect of the invention, the water distributor 35 comprises one or more inlet connectors 36*a*, 36*b*, 36*c*, 36*d* and 36*e* fluidly connected to said one or more water conveying lines 120*a*, 120*b*, 120*c*, 120*d*, 120*e* and the respective inlets 121*a*, 121*b*, 121*c*, 121*d*, 121*e*. Inlet connectors 36*a*, 36*b*, 36*c*, 36*d* and 36*e* are opportunely connected to the valves assembly 40 through respective pipes 34*a*, 34*b*, 34*c*, 34*d* and 34*e*. Preferably, the first inlet connector 36*a* is connected through the first pipe 34*a* to the first controllable valve 40*a*, the second inlet connector 36*b* is connected through the second pipe 34*b* to the second controllable valve 40*b*, the third inlet connector 36*c* is connected through the third pipe 34*c* to the third controllable valve 40*c*, the fourth inlet connector 36*d* is connected through the fourth pipe 34*d* to the fourth controllable valve 40*d* and the fifth inlet connector 36*e* is connected through the fifth pipe 34*e* to the fifth controllable valve 40*e*.

Cold and/or hot/warm water is conveyed to one or more of said compartments 23*a*, 23*b*, 23*c*, 23*d* of the drawer 22 by selectively activating one or more of the valves 40*a*, 40*b*, 40*c*, 40*d*, 40*e* and making the water flow through the respective pipe 34*a*, 34*b*, 34*c*, 34*d*, 34*e* and water conveying line 120*a*, 120*b*, 120*c*, 120*d*, 120*e* up to the outlets 29. In other preferred embodiments, not illustrated, in the drawer there can be more than four compartments, and in the water distributor there can be more than six channels, each one fluidly communicating with a different region of the water distributor which is positioned in such a way to be placed above a different compartment of the drawer when the latter is placed in its closed operative position; also in this case, by acting on the controllable valves, it is possible to selectively feed a desired channel with water coming from the water source.

In further embodiments, not illustrated, in the drawer there can be less than four compartments, even just one, and in the water distributor there can be less than six channels, each one fluidly communicating with a different region of the water distributor which is positioned in such a way to be placed above a different compartment of the drawer when the latter is placed in its closed operative position; also in this case, by acting on the controllable valves, it is possible to selectively feed a desired channel with water coming from the water source.

According to an aspect of the invention, the inlet connectors 36*a*, 36*b*, 36*c*, 36*d*, 36*e* preferably each comprises a projecting body 136*a*, 136*b*, 136*c*, 136*d*, 136*e* extending along a main axis X which is inclined with respect to the sliding axis S. More preferably, the projecting body 136*a*, 136*b*, 136*c*, 136*d*, 136*e* extends downwardly and preferably along a main axis X which is perpendicular with respect to the sliding axis S. Preferably, the main axis X lies in the vertical, or substantially vertical, plane when the treating agents dispenser 20 is mounted in an operational position. More preferably, the main axis X is perpendicular to the horizontal plane when the treating agents dispenser 20 is mounted in an operational position and the water distributor 35 lies in the horizontal plane.

The projecting bodies 136*a*, 136*b*, 136*c*, 136*d*, 136*e* of the inlet connectors 36*a*, 36*b*, 36*c*, 36*d*, 36*e* are preferably cylindrically shaped. This enhances connection of the pipes 34*a*, 34*b*, 34*c*, 36*d*, 34*e* to the inlet connectors 36*a*, 36*b*, 36*c*, 36*d*, 36*e*. More preferably, the projecting bodies 136*a*, 136*b*, 136*c*, 136*d*, 136*e* of the inlet connectors 36*a*, 36*b*, 36*c*, 36*d*, 36*e* comprises an annular projecting rib 137*a*. This further enhances connection of the pipes 34*a*, 34*b*, 34*c*, 36*d*, 34*e* to the inlet connectors 36*a*, 36*b*, 36*c*, 36*d*, 36*e*.

In preferred embodiments, connection of the pipes 34*a*, 34*b*, 34*c*, 36*d*, 34*e* to the inlet connectors 36*a*, 36*b*, 36*c*, 36*d*, 36*e* comprises fastening means, for example clamps. Clamps preferably tighten ends of the pipes 34*a*, 34*b*, 34*c*, 36*d*, 34*e* around the projecting bodies 136*a*, 136*b*, 136*c*, 136*d*, 136*e* of the inlet connectors 36*a*, 36*b*, 36*c*, 36*d*, 36*e*. Preferably, the valves assembly 40 is arranged vertically below the water distributor 35, more preferably just below the free ends of the inlet connectors 36*a*, 36*b*, 36*c*, 36*d*, 36*e*. More generally, the valves assembly 40 is arranged spaced apart from the free ends of the inlet connectors 36*a*, 36*b*, 36*c*, 36*d*, 36*e* along the main axis X. Such arrangement allows to minimize the interspace between the treating agents dispenser 20 and the valves assembly 40 and allows the assembly of the treating agents dispenser 20 closer to the valves assembly 40 compared to known systems.

Advantageously, the size of the laundry washing machine 1, for example the distance between the front side wall 2*a* and the rear side wall 2*b*, may be reduced compared to known systems. On the other hand, while maintaining the same external size of the laundry washing machine 1, it is possible to increase the size of the treating agents dispensers 20, in particular of the drawer 22, compared to known systems. This helps to adopt a better design solution for the treating agents dispensers 20 and/or for the drawer 22. Said arrangement, furthermore, allows to minimize the length of the pipes 34*a*, 34*b*, 34*c*, 34*d*, 34*e* and therefore to reduce the complexity of the laundry washing machine 1.

Pipes 34*a*, 34*b*, 34*c*, 34*d*, 34*e* substantially comprise short L-shaped pipes portion. Pipes 34*a*, 34*b*, 34*c*, 34*d*, 34*e* preferably comprise flexible pipes, more preferably plastic flexible pipes.

Advantageously, the arrangement according to the invention allows to reduce costs of production and assembly time of the pipes and/or of the treating agents dispensers 20. Furthermore, arrangement of the inlet connectors 36*a*, 36*b*, 36*c*, 36*d*, 36*e* perpendicularly with respect to the plane of the distributor 35 facilitates the manufacturing process of the distributor 35, in particular when a molding process is involved.

The inlet connectors 36*a*, 36*b*, 36*c*, 36*d*, 36*e* are preferably integrally made with the water distributor 35, more preferably integrally made with the lower part 35*a* of the water distributor 35. The water distributor 35 and/or the inlet connectors 36*a*, 36*b*, 36*c*, 36*d*, 36*e* are preferably made of Polypropylene (PP).

In the preferred embodiment above illustrated and described, the projecting bodies 136*a*, 136*b*, 136*c*, 136*d*, 136*e* of the inlet connectors 36*a*, 36*b*, 36*c*, 36*d*, 36*e* are parallel one to the other and extend along the main axis X. In different preferred embodiments, inlet connectors may extend along different axes one to the other and each extending along a respective axis which is preferably inclined with respect to the sliding axis S.

Figure 11:
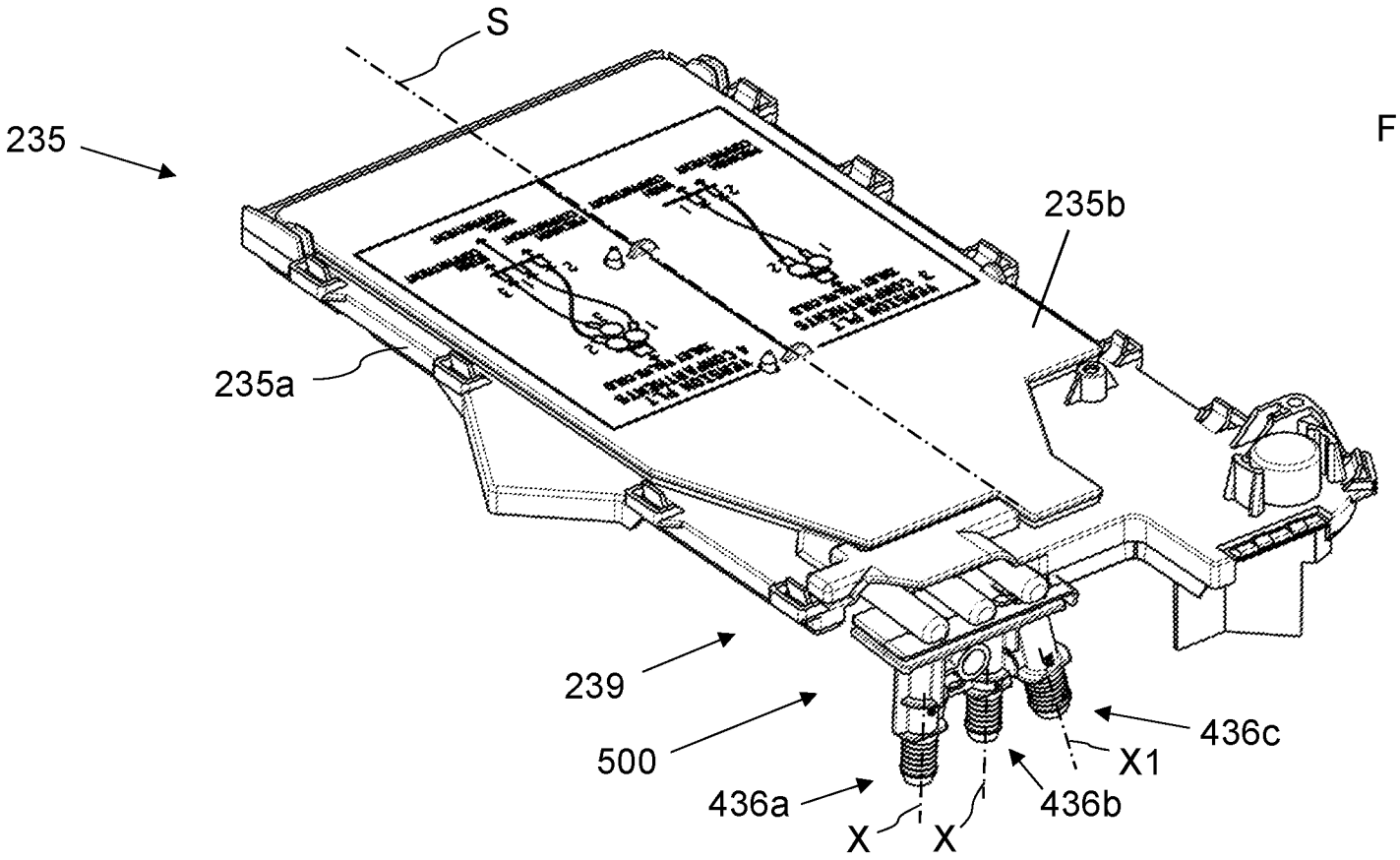
FIG. 11 shows a further preferred embodiment in a view similar to FIG. 6.
Figure 12:
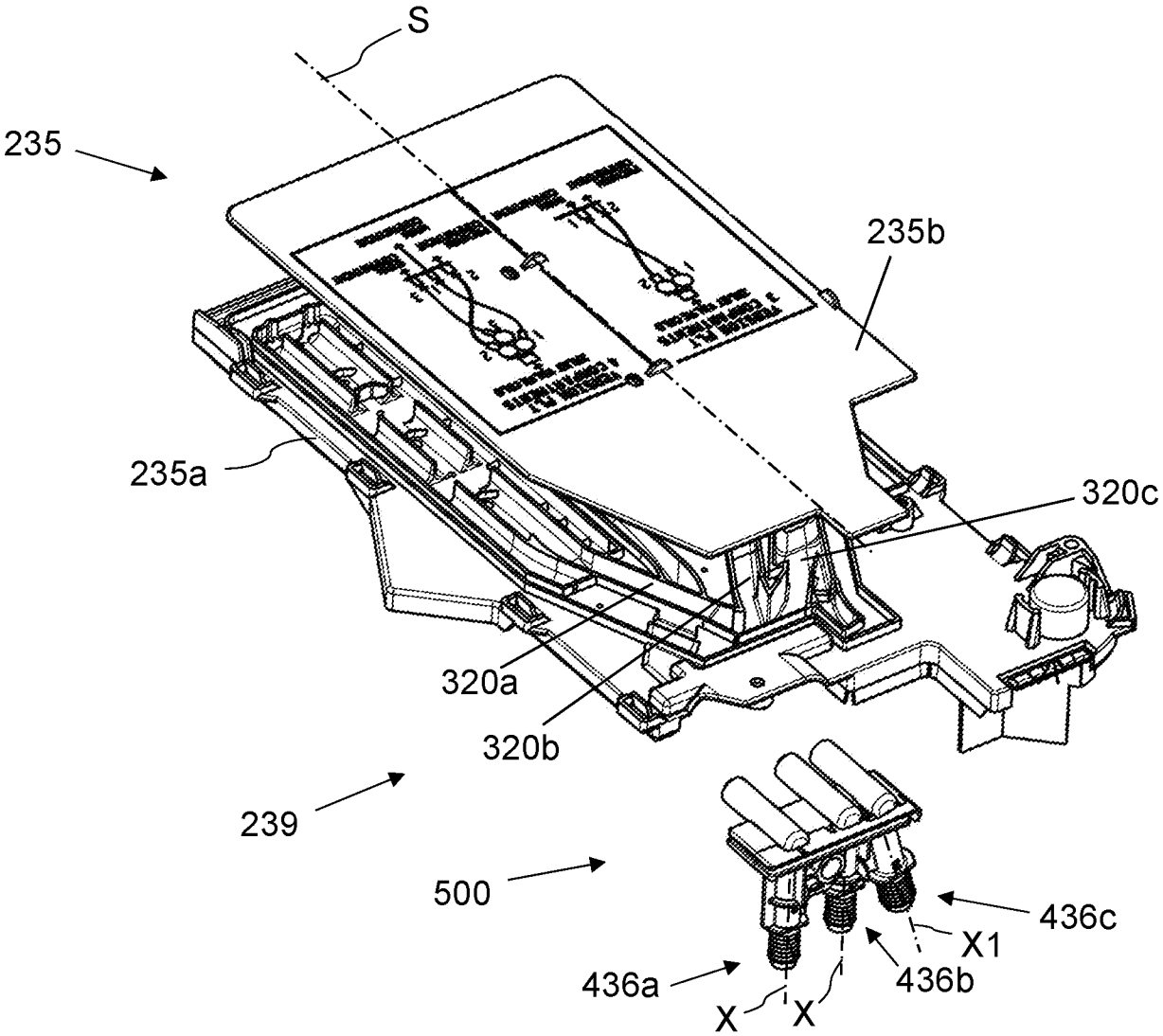
FIG. 12 shows an exploded view of FIG. 11.
Figure 13:
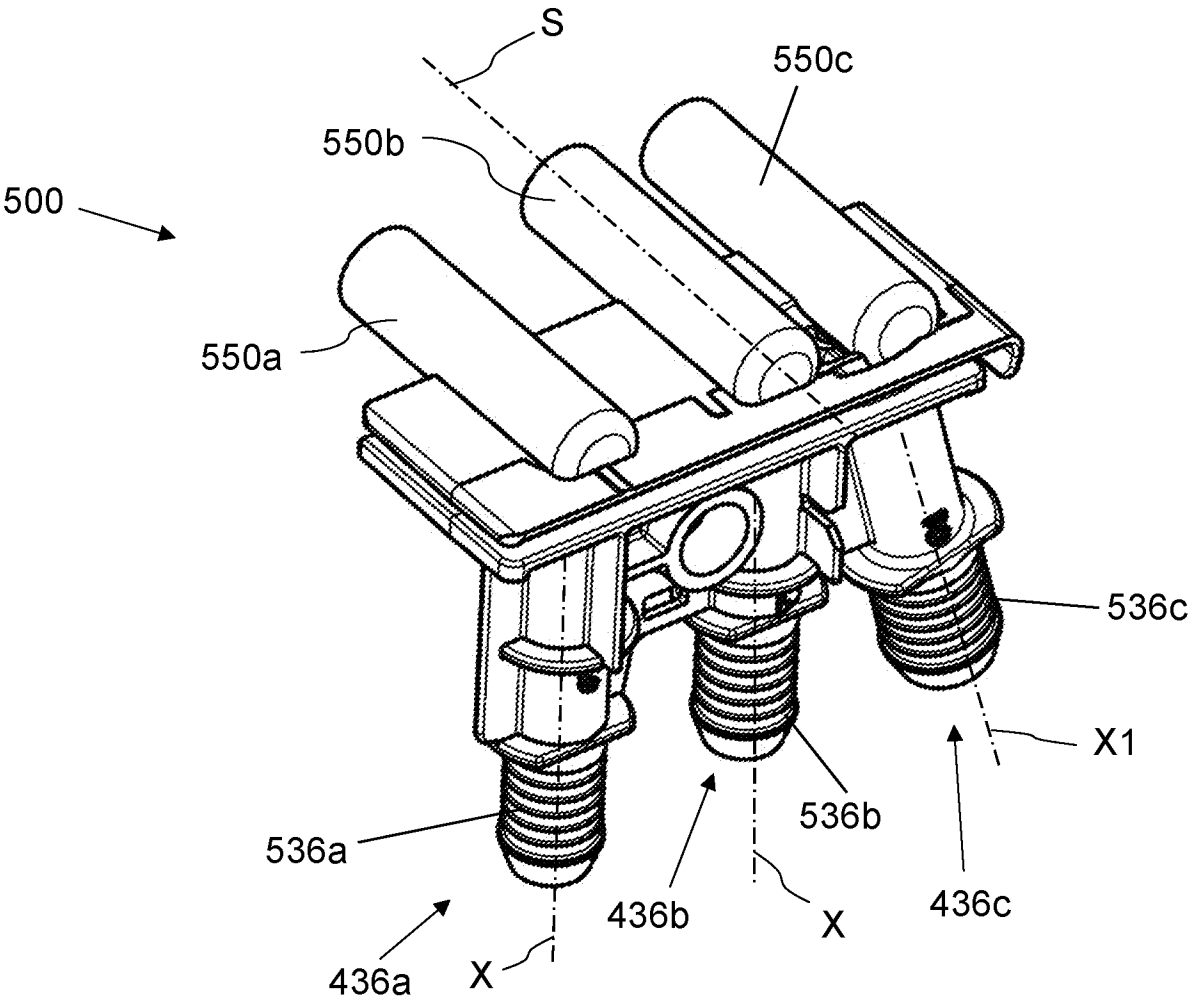
FIG. 13 shows an enlarged view of a detail of FIG. 12.

FIGS. 11 to 13 illustrate a further embodiment of a water distributor 235 of a treating agents dispenser according to the present invention. The water distributor 235 comprises three water conveying lines 320*a*, 320*b*, 320*c* adapted for selectively conveying water to one or more of the compartments of a drawer. The water conveying lines 320*a*, 320*b*, 320*c* are opportunely shaped to create channels adapted for conveying water to one or more of said compartments of the drawer when the latter is placed in its closed operative position. The channels are provided with outlets facing the underlying compartments that allow the passage of the water from the water distributor 235 to the underlying compartments.

The water distributor 235 preferably comprises a lower part 235*a* and an upper closing part 235*b* structured for being reciprocally coupled to form the water distributor 235. The two parts 235*a*, 235*b* are preferably coupled by welding and/or glueing and/or joint. The water distributor 235 preferably has a substantially flattened configuration. The water distributor 235 preferably extends along the sliding axis S and preferably lies in the horizontal, or substantially horizontal, plane when the treating agents dispenser is mounted in an operational position.

According to the invention, the water distributor 235 comprises three inlet connectors 436*a*, 436*b*, 436*c* fluidly connected to said water conveying lines 320*a*, 320*b*, 320*c*.

According to an aspect of the invention, the inlet connectors 436*a*, 436*b*, 436*c*, preferably each comprises a projecting body 536*a*, 536*b*, 536*c* extending along a respective axis X, X, X1 which is inclined with respect to the sliding axis S. More preferably, the projecting bodies 536*a*, 536*b* of the first two inlet connectors 436*a*, 436*b* extend downwardly and preferably along a main axis X which is perpendicular with respect to the sliding axis S. More preferably, the projecting body 536*c* of the third inlet connector 436*c* extends downwardly and preferably along an axis X1 which is inclined with respect to the sliding axis S.

Preferably, the axes X, X1 lie in the vertical, or substantially vertical, plane when the treating agents dispenser is mounted in an operational position. More preferably, the axes X, X1 are perpendicular to the horizontal plane when the treating agents dispenser is mounted in an operational position and the water distributor 235 lies in the horizontal plane.

According to an aspect of the present embodiment, the inlet connectors 436*a*, 436*b*, 436*c* are integrally made as a separate unit 500 which is coupled to the water distributor 235. Preferably, the unit 500 is sandwiched between the two parts 235*a*, 235*b* of the water distributor 235. The unit 500 preferably then comprises interconnecting portion 550*a*, 550*b*, 550*c* which fluidly connect the inlet connectors 436*a*, 436*b*, 436*c* to the water conveying lines 320*a*, 320*b*, 320*c*. The interconnecting portion 550*a*, 550*b*, 550*c* are preferably integrally made with the inlet connectors 436*a*, 436*b*, 436*c*. The unit 500 is preferably arranged close to the rear side 239 of the distributor 235. This second embodiment achieves all the advantages above described for the previous embodiment.

It has thus been shown that embodiments of the invention allow the stated objects to be achieved. In particular it is possible to realize a laundry washing machine having a treating agents dispenser with reduced size compared to laundry washing machines of known type.

It is underlined that the laundry washing machines illustrated in the enclosed figures are of the front-loading type; however it is clear that the system according to the invention can be applied as well to a top-loading washing machine, substantially without any modification.

While the present invention has been described with reference to water conveying lines adapted for conveying water to one or more compartments of the drawer, it should be noted that the present invention is not limited to this specific embodiment but can be extended to other embodiments. In a different embodiment, for example, a water conveying line of the water distributor may be opportunely shaped to define a by-pass line. The by-pass line preferably allows the flowing of water into the tub without entering the compartments of the drawer.

In a further different embodiment, for example, a water conveying line of the water distributor may be opportunely shaped to preferably allow the flowing of water to a reservoir/container of a water softening device of the laundry washing machine. The water softening device advantageously removes calcium, magnesium and/or certain other metal cations in hard water before it reaches the compartments of the water distributor and/or before it is conveyed directly into the tub. The water softening device advantageously comprises water softening products, such as salt, introduced into the reservoir for regenerate the softener agents provided in a further reservoir. In a preferred embodiment, the container for the water softening products is preferably supported by the drawer. In further preferred embodiments, the container for the water softening products may be preferably supported by the supporting structure of the treating agent dispenser. In other preferred embodiments, the container for the water softening products may be external to the treating agents dispenser.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A laundry washing machine connectable to a water mains comprising a cabinet supporting a washing tub enclosing a rotatable washing drum suited to receive laundry and a treating agents dispenser connectable to said water mains by means of a plurality of supply valves, said treating agents dispenser comprising:

a drawer and a supporting structure on which said drawer can slide along a sliding axis;

a water distributor comprising a rear wall facing a rear side of the laundry washing machine and a bottom surface facing a bottom side of the laundry washing machine, a plurality of water conveying lines, each of the respective water conveying lines including a respective water inlet for exclusively receiving water, and each of the respective water conveying lines including a respective water outlet for exclusively conveying the received water to a reservoir or to said washing tub, each of the respective water conveying lines terminating at the respective water inlet, wherein the respective water inlet of each of the respective water conveying lines is positioned on the bottom surface of the water distributor; and a plurality of inlet connectors extending along a main axis which is inclined with respect to said sliding axis from the bottom surface of the water distributor towards the bottom side of the laundry washing machine, each of said respective inlet connectors being adapted to connect each of the respective supply valves to each of said respective water inlets via a respective pipe that extends along the main axis from the inlet connectors, wherein at least one of the respective water conveying lines is positioned between at least one of the respective water inlets and the rear wall.

2. A machine according to claim 1, wherein said reservoir comprises a compartment of said drawer suitable to receive an agent for treating laundry.

3. A machine according to claim 1, wherein said reservoir comprises a container suitable to receive a water softening product to be used in a water softening device of the laundry washing machine.

4. A machine according to claim 3, wherein said container is supported by said drawer or by said supporting structure or is external to said treating agents dispenser.

5. A machine according to claim 1, wherein said main axis is perpendicular with respect to said sliding axis.

6. A machine according to claim 1, wherein said main axis is arranged in a vertical plane or substantially vertical plane, when said treating agents dispenser is mounted in an operational position.

7. A machine according to claim 1, wherein said sliding axis is arranged in a horizontal or substantially horizontal plane, when said treating agents dispenser is mounted in an operational position.

8. A machine according to claim 1, wherein said at least one inlet connector is integrally made with said water distributor.

9. A machine according to claim 1, wherein said water distributor comprises a first part and a second part structured for being reciprocally coupled.

10. A machine according to claim 9, wherein said at least one inlet connector is integrally made with one of said first or second parts of said water distributor.

11. A machine according to claim 9, wherein said at least one inlet connector is coupled to said water distributor.

12. A machine according to claim 11, wherein said at least one inlet connector is part of a unit sandwiched between said first and second parts.

13. A machine according to claim 1, further comprising a pipe fluidly connecting said at least one inlet connector to said at least one supply valve.

14. A machine according to claim 1, wherein said drawer is movable in a withdrawal direction in order to extract said drawer from said supporting structure and is movable in a pushing direction in order to insert said drawer into said supporting structure.

15. A machine according to claim 14, wherein said withdrawal direction and/or said pushing direction is parallel to said sliding axis.

16. The laundry washing machine according to claim 1, wherein said at least one supply valve is arranged below the water distributor.

* * * * *